United States Patent [19]

Hamilton

[11] 3,932,855

[45] Jan. 13, 1976

[54] CRANE RADIUS INSTRUMENT

[75] Inventor: Martin W. Hamilton, Arlington Heights, Ill.

[73] Assignee: Eaton Corporation, Ohio

[22] Filed: Sept. 6, 1974

[21] Appl. No.: 503,660

[52] U.S. Cl. ..... 340/267 C; 212/39 A; 235/186

[51] Int. Cl.[2] ..... G08B 21/00

[58] Field of Search ..... 340/267 C; 212/39 A; 235/186, 193

[56] References Cited

UNITED STATES PATENTS

| | | | |
|---|---|---|---|
| 3,079,080 | 2/1963 | Mason | 340/267 C |
| 3,549,876 | 12/1970 | Hamilton | 340/267 C |
| 3,819,922 | 6/1974 | Horn et al. | 340/267 C |

*Primary Examiner*—Glen R. Swann, III

*Attorney, Agent, or Firm*—John R. Dwelle

[57] ABSTRACT

A transducer is mounted on the boom to produce an electrical signal proportional to the angle the boom has moved in a horizontal plane. A resistance related to the boom length receives the output of the transducer and supplies a current proportional to L Cos $\theta$ where L is the boom length. A potentiometer supplies a current proportional to the offset distance from the boom hinge point to the rotating axis of the crane and an indicator means receives the current proportional to both the L Cos $\theta$ and the offset distance for indicating the operational radius of the crane.

8 Claims, 2 Drawing Figures

CRANE RADIUS INSTRUMENT

BACKGROUND OF THE INVENTION

1. Field of the Invention

This invention relates in general to indicating and warning devices for cranes.

2. Description of the Prior Art

Complex and expensive crane warning devices have been known prior to my invention.

SUMMARY OF THE INVENTION

The present invention comprises a simple crane radius indicator and warning device which utilizes a cosine function potentiometer mounted to the crane boom so as to produce a signal cos $\theta$ which is supplied to an operational amplifier which is a differential amplifier, and passed through a resistance proportional to the length of the boom and then to a meter which also receives a current indicative of the offset distance between the center of the crane and the pivot point of the boom. The meter indicates the operating radius of the machine to the operator. An alarm is provided for giving a warning when unsafe conditions exist.

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
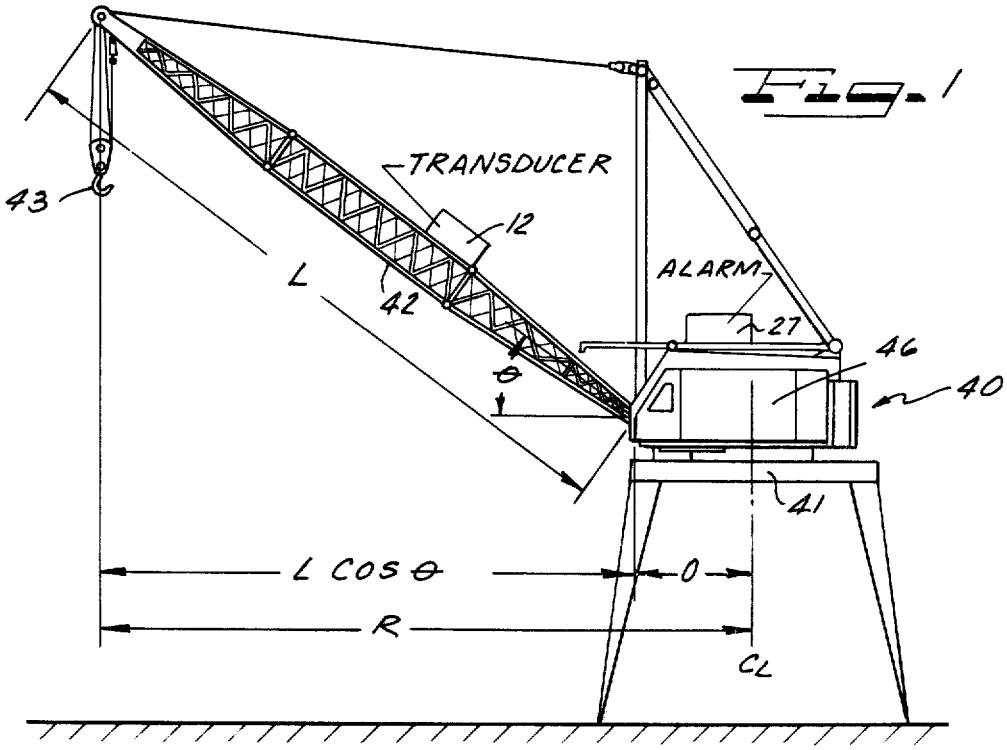
FIG. 1 is a side elevation view of a crane.

The specific load capacity rating of a crane is generally given as a function of the operating radius or reach defined by equation (1)

$$R = L\text{Cos}\,\theta + 0 \qquad (1)$$

where $L$ is equal to the boom length as defined in FIG. 1, $\theta$ is the angle of the boom with respect to the earth's horizontal, $L$Cos $\theta$ is the horizontal projection of the boom length at the angle $\theta$ and O is the offset distance from the center line of the rotating base of the crane to the boom hinge point.

A critical load can create a moment sufficient to cause the machine to topple and thus the operator of the crane must always be aware of the operating radius of the machine such that a moment sufficient to topple the crane will $L$ exist. The present invention provides a simple electronic device for solving the equation $R = L\text{Cos}\,\theta + 0$ and displays the resulting answer $R$ in feet (or meters) on a linear scale meter.

Figure 2:
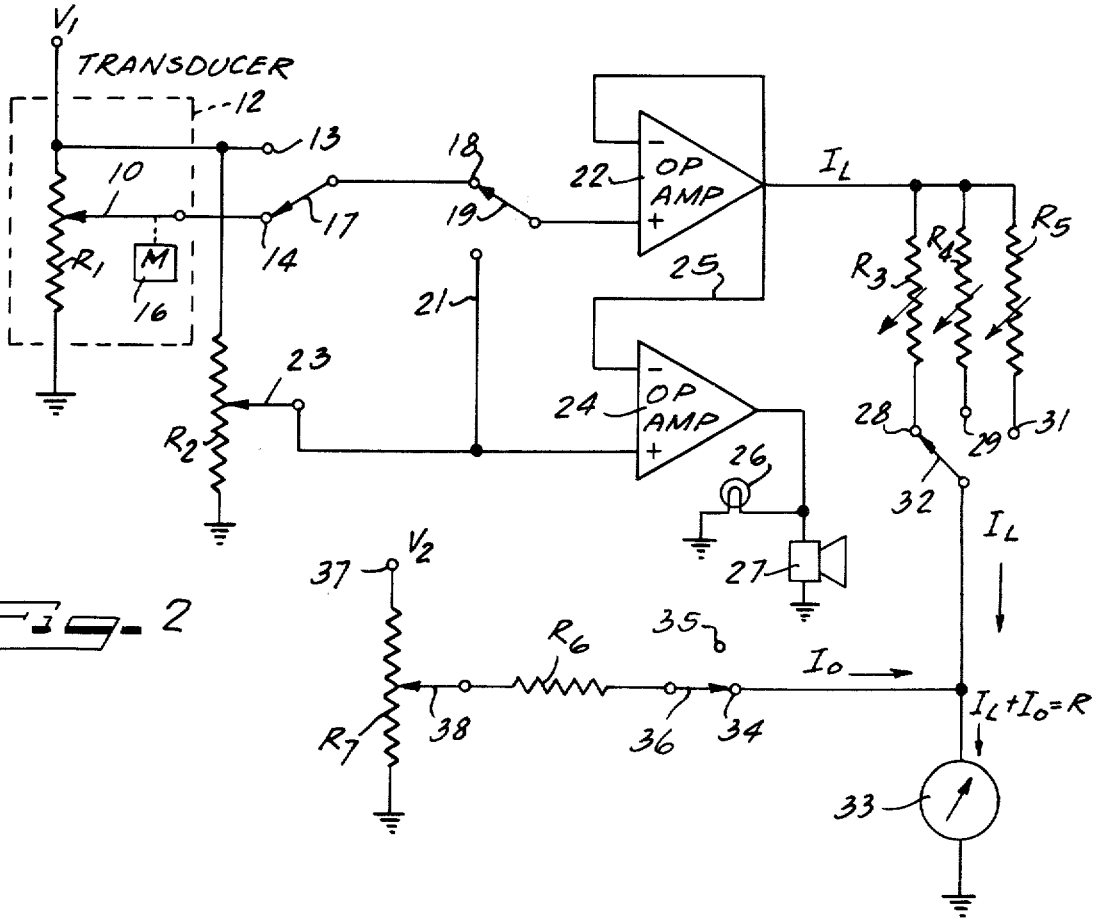
FIG. 2 is an electrical schematic illustrating the invention.

The device might be used primarily for gantry or locomotive type cranes that normally operate with a fixed boom length. However, it is to be realized that mobile, crawler or other types of cranes can also utilize the invention as long as the boom length used provides operating radii within the range that can reasonably be displayed on a panel meter. FIG. 1 illustrates a crane 40 which includes a cab 46 supported about a pivotal axis 41. The boom 42 of the crane is pivotally supported on a horizontal axis from the crane offset by a distance O from the pivot axis 41 and a transducer 12 is mounted on the boom to produce the output proportional to $L$Cos $\theta$ where $l$ is the length of the boom. A hook 43 supports the load. FIG. 2 is a block diagram of the invention. The boom transducer unit 12 is mounted on the crane boom and generates a precise signal voltage that is proportional to the cosine of the boom angle. A gravity sensitive pendulum 16 controls the position of a wiper contact 10 which wipes against a cosine function potentiometer R1. One side of the potentiometer R1 is connected to ground and the other side receives an input voltage $V_1$. The wiper contact 10 is connected to a terminal 14 engageable with a movable switch contact 17. The voltage $V_1$ is connected to a terminal 13 engageable with switch contact 17 and is supplied to one end of a resistor R2 which has its other side connected to ground. A wiper contact 23 is engageable with resistor R2. An operational amplifier 22 is connected by a switch contact 19 to a terminal 18 which is connected to switch 17. The operational amplifier 22 provides a high input impedance to prevent potentiometer loading errors. The operational amplifier is connected to operate as a voltage follower which converts the input cosine signal from switch 17 to a proportional output signal which is capable of supplying current to a resistive load with minimum loading errors.

The output of the operational amplifier, which is a differential amplifier, is supplied to one end of a variable resistor $R_3$ which has its other side connected to a contact 28 engageable with switch 32 that is connected to meter 33. The variable series resistance R3 is a function of the length of the boom $L$ Since $V_1\text{Cos}\,\theta \times 1/R3 = I$, the Current $I_L$ represents the solution to the equation $L$Cos $\theta$. Since the current $I_L$ also flows through the low resistance meter 33 to ground, the meter can be calibrated to read $L$Cos $\theta$ directly in feet, meters or other units of linear measurement. In order to add the offset distance O for indicating the operating radius, there is provided a simple constant current source consisting of a relatively high value resistor $R_6$ which is connected to the wiper contact 38 so as to receive a variable stable voltage source from the potentiometer R7 which is driven by the voltage V2. The constant current $I_0$ is fed into the meter 33 and is adjusted to represent the offset distance O by the necessary number of increments on the meter face representing the offset distance.

A second operational amplifier 24 is connected to the wiper contact 23 and by a lead 21 to a terminal engageable by switch 19. The output of operational amplifier 24 is connected to an alarm 27 and to an indicator light 26. The negative inputs of the operational amplifiers 22 and 25 are connected together by a lead 25.

The circuit solves the equation $R = L\text{Cos}\,\theta + 0$ and the result will be displayed on meter 33. The differential amplifier circuit compares the Cos $\theta$ voltage signal to a reference signal that is manually set by a wiper contact 23 on a potentiometer $R_2$. Since the voltage Cos $\theta$ will equal or exceed the reference voltage, at some related radii, the resulting switch action of the differential amplifier will operate the audible and/or visual alarms 27 and 26 to give a warning signal to the machine operator. By momentarily moving the switch contact 19 to engage lead 21, the desired alarm set point can be adjusted by observing the display meter 33 as the wiper contact 23 is adjusted relative to the potentiometer $R_2$.

For test purposes, switch 17 is moved to engage terminal 13 and switch 36 to engage open circuit terminal 35, thus applying a voltage corresponding to 1 (cosine of 0) and removing the offset current from the meter. Under these conditions, the meter will indicate the boom length for the specific machine upon which the invention has been utilized.

Movement of the test switches 17 and 36 to engage the terminals 13 and 35 will also normally activate the alarms 26 and 27, thus providing a test indicating that the alarms are operating.

In the event a machine utilizes two or more hook blocks located at different positions on the boom, a different resistive element such as variable resistors R4 and R5 can be connected between the output of the operational amplifier 22 and contacts 29 and 31 engageable with switch 32 and the resistors R4 and R5 represent the boom lengths to the different hooks supported by the boom 42.

It is seen that this invention provides a simple and inexpensive circuit which allows a crane operator to monitor the operating radius of the crane and further provides warning signals when unsafe conditions exist.

Although the invention has been described with respect to preferred embodiments, it is not to be so limited as changes and modifications may be made which are within the full intended scope as defined by the appended claims.

I claim as my invention:

1. Means for indicating the operating radius of a crane comprising, a transducer mounted on the boom of said crane and producing an electrical signal proportional to cosine $\theta$, where $\theta$ is the angle of said boom with the horizontal plane, a first resistor having a conductance related to the length of said boom receiving the output of said transducer and supplying a current proportional to $L\text{Cos}\ \theta$ where $L$ is the length of said boom, a first potentiometer supplying a current proportional to the offset distance which is the distance from the boom hinge point to the rotating axis of said crane, and an indicator receiving the currents proportional to $L\text{Cos}\ \theta$ and the offset distance to indicate the operating radius of said crane.

2. Means for indicating the operating radius of a crane according to claim 1 wherein said transducer includes a cosine wound second potentiometer and a gravity pendulum connected to said second potentiometer.

3. Means for indicating the operating radius of a crane according to claim 2 including an operational amplifier connected between said transducer and said resistor.

4. Means for indicating the operating radius of a crane according to claim 3 including a third potentiometer with a wiper contact, a first reference voltage source connected to said second and third potentiometers, a differential amplifier receiving said Cos $\theta$ signal and a signal from the wiper contact of said third potentiometer, and an alarm connected to the output of said differential amplifier.

5. Means for indicating the operating radius of a crane according to claim 4 including a second reference voltage source connected to said first potentiometer, and a second resistor connected between said first potentiometer and said indicator.

6. Means for indicating the operating radius of a crane according to claim 5 including first switch means for disconnecting said operational amplifier from said transducer and connecting it to said third potentiometer.

7. Means for indicating the operating radius of a crane according to claim 6 including second and third switching means with said second switching means for disconnecting the input of said operational amplifier from said transducer and connecting to said first reference voltage source, and said third switching means for disconnecting said indicator from said first potentiometer.

8. Means for indicating the operating radius of a crane according to claim 1 including means for varying said first resistor to obtain different boom lengths.

* * * * *

UNITED STATES PATENT AND TRADEMARK OFFICE

CERTIFICATE OF CORRECTION

PATENT NO. : 3,932,855

DATED : 1/13/76

INVENTOR(S) : Martin W. Hamilton

It is certified that error appears in the above-identified patent and that said Letters Patent are hereby corrected as shown below:

In the Abstract: After the last sentence, the following sentence has been omitted. Should read "An alarm is provided when the electrical signal proportional to the boom angle exceeds a preset threshold."

Col. 1, line 54: "L" should read "not".

Col. 2, line 53: "25" should read "24".

Signed and Sealed this thirtieth Day of March 1976

[SEAL]

Attest:

RUTH C. MASON
*Attesting Officer*

C. MARSHALL DANN
*Commissioner of Patents and Trademarks*